US008332981B2

(12) United States Patent
Woo et al.

(10) Patent No.: US 8,332,981 B2
(45) Date of Patent: Dec. 18, 2012

(54) MODULAR BICYCLE GUTTER

(75) Inventors: Christopher Woo, Portland, OR (US); Gary Granger, Lake Oswego, OR (US)

(73) Assignee: Oregon Health & Science University, Portland, OR (US)

( * ) Notice: Subject to any disclaimer, the term of this patent is extended or adjusted under 35 U.S.C. 154(b) by 70 days.

(21) Appl. No.: 12/986,902

(22) Filed: Jan. 7, 2011

(65) Prior Publication Data

US 2012/0174325 A1 Jul. 12, 2012

(51) Int. Cl.
*E04G 27/00* (2006.01)
*E01D 1/00* (2006.01)

(52) U.S. Cl. ..... 14/69.5; 193/38

(58) Field of Classification Search ..... 14/69.5; 193/38

See application file for complete search history.

(56) References Cited

U.S. PATENT DOCUMENTS 1,699,065 A * 1/1929 Hilpert ..... 472/116
2,270,909 A * 1/1942 Spizer ..... 472/116
2,312,273 A * 2/1943 Stochmal ..... 238/10 R
3,009,183 A * 11/1961 Lay ..... 14/69.5
4,165,810 A 8/1979 Young
D264,199 S 5/1982 Wood
4,712,264 A * 12/1987 Voith ..... 14/69.5
D299,078 S 12/1988 Jacobsen
4,813,663 A * 3/1989 Rice ..... 472/116
4,943,048 A * 7/1990 Hentges ..... 472/116
D311,798 S 10/1990 Boots et al.
4,991,691 A * 2/1991 Brawer et al. ..... 182/106
5,077,852 A 1/1992 Karlsson
5,137,114 A * 8/1992 Yde et al. ..... 182/49
D329,519 S 9/1992 Holloway, Jr.
5,197,924 A * 3/1993 Gerrells ..... 472/116
5,277,436 A * 1/1994 Frank et al. ..... 280/5.2
5,341,533 A 8/1994 Seitz
D353,929 S 12/1994 Kincaid
5,446,937 A 9/1995 Haskins
5,517,708 A * 5/1996 Baranowski ..... 14/69.5
D373,885 S 9/1996 Holland, Jr.
5,711,227 A 1/1998 Johnson
5,911,465 A 6/1999 Yamamoto et al.
5,933,898 A 8/1999 Estes et al.
D434,542 S 11/2000 Wickstead
6,158,797 A 12/2000 Bauer
6,644,628 B1 11/2003 Triche
6,695,565 B1 2/2004 Franchuk
6,957,716 B1 * 10/2005 Norris ..... 182/48
7,043,789 B2 5/2006 Morrish
D550,922 S 9/2007 Bain
7,571,507 B2 * 8/2009 Holicki ..... 14/69.5
D602,673 S 10/2009 Allen
7,930,788 B1 4/2011 Beilstein

OTHER PUBLICATIONS

"7.0 Bicycle Design Standards/7.9 Staircase Design," Western Washington University Campus Planning Studio: Transportation, http://www.ac.wwu.edu/sustwwu/trans/report/standards/toc.htm, Nov. 16, 2009.

(Continued)

*Primary Examiner* — Raymond W Addie
(74) *Attorney, Agent, or Firm* — Schwabe, Williamson & Wyatt

(57) ABSTRACT

Embodiments herein provide a modular gutter for use by bicycles and other conveyances. When utilized, a conveyance may be guided along the gutter either by an individual on the conveyance or adjacent to it, whether up or down the gutter. The gutter may be manufactured in various lengths and arrangements, and additionally, the components of the gutter are designed to permit multiple subunits to be coupled to form longer gutters. Alternatively, the gutters may be cut to a desired length should the manufactured length be too long. Thus, the gutter may be sized for any of a variety of staircases. The gutter may be removably installed on existing staircases without the need to redesign or reconstruct the staircase.

22 Claims, 9 Drawing Sheets

OTHER PUBLICATIONS

"How can we accommodate baby strollers and bicycles on outdoor staircases?" http://walkinginfo.org/faqs/answer.cfm?id=3977, Nov. 17, 2009.

Maus, Jonathan, "Taking bikes on the new tram," http://bikeportland.org/2006/12/19/taking-bikes-on-the-new-tram/, Nov. 16, 2009.

Miller, A. Richard, "Bicycle Stairs," http://www.millermicro.com/BicycleStairs.html, Nov. 16, 2009.

"Wheelchair Ramps," http://www.globalindustrial.com/c/safety/wheelchairs-1/Wheelchair1-Ramps, Global Equipment Company, Inc.

* cited by examiner

MODULAR BICYCLE GUTTER

TECHNICAL FIELD

Embodiments herein relate to the field of ramps and gutters, and, more specifically, to a modular gutter for use by bicycles and other conveyances.

BACKGROUND

Bicycles and other conveyances have some difficulty traversing stairs. A rider traversing stairs must often carry his bicycle or carefully maneuver the bicycle along the staircase or else risk damaging the bicycle or potentially suffering an injury.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
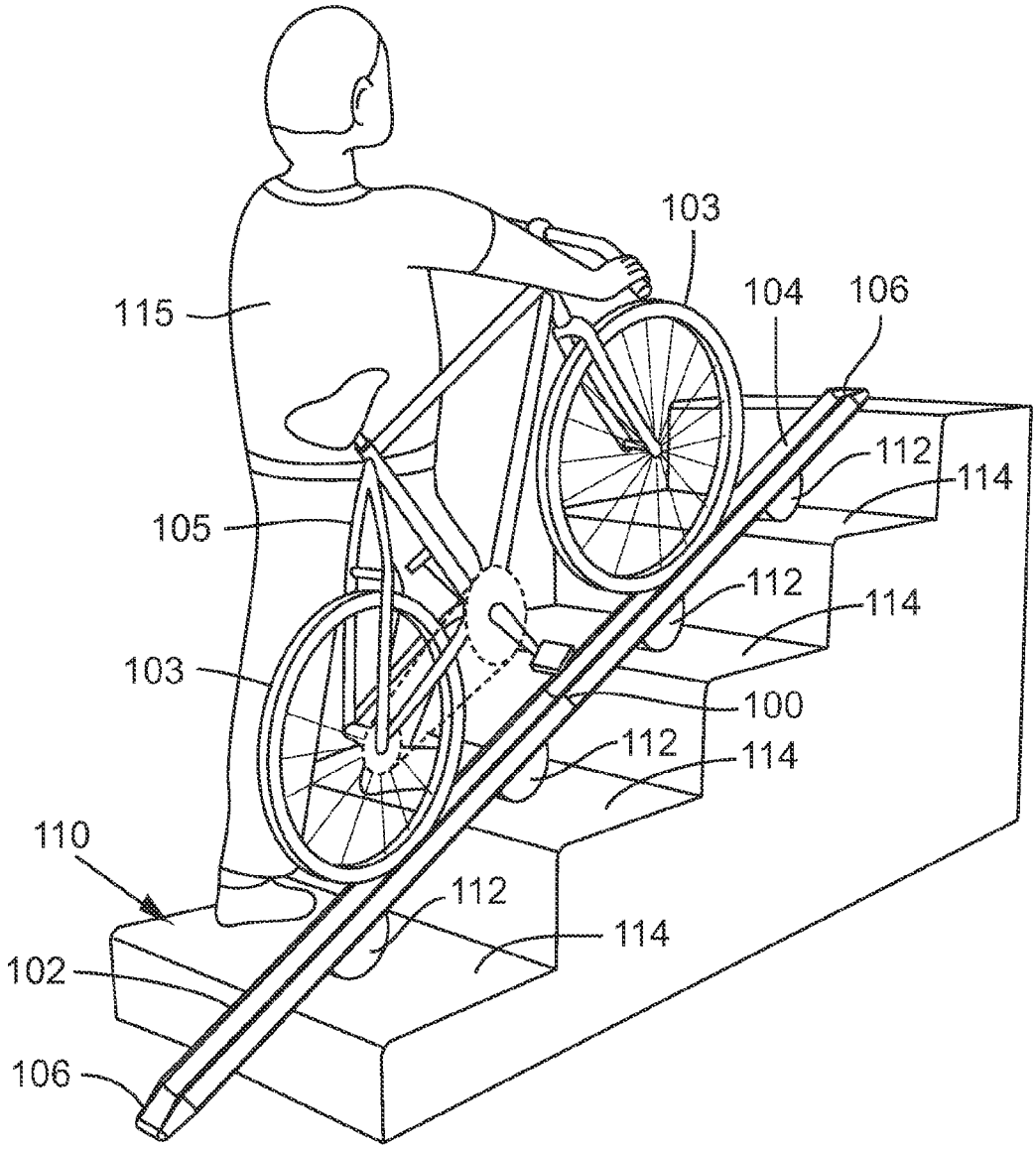
FIG. 1A illustrates a modular gutter in accordance with embodiments herein.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a modular gutter for use by bicycles and other conveyances. When utilized, a conveyance may be guided along the gutter either by an individual on the conveyance or adjacent to it, whether up or down the gutter. The gutter may be manufactured in various lengths and arrangements, and additionally, the components of the gutter are designed to permit multiple subunits/segments to be coupled to form longer gutters. Alternatively, the gutters may be cut to a desired length should the manufactured length be too long. Thus, the gutter may be sized for any of a variety of staircases. The gutter may be removably installed on existing staircases without the need to redesign or reconstruct the staircase.

A bicycle is described herein as an example embodiment, although a modular gutter may be used for other conveyances as well. For the purposes of describing embodiments herein, the term "conveyance" refers broadly to wheeled vehicles and other such devices, whether motorized or non-motorized, whether for carrying one or more individuals or not, such as unicycles, bicycles, tricycles, quads, skateboards, strollers, carts, etc.

FIG. 1A illustrates a modular gutter 100 in accordance with embodiments herein. Gutter 100 includes two rail segments 102 and 104 coupled together. Rail segments 102, 104 are shown with a concave or u-shaped upper surface configured to permit smooth movement of bicycle tires 103 of bike 105 along the surface. In addition, there are upper and lower endcaps 106, both of which are coupled to rail segments 102, 104. Endcaps 106 may be the same or each may be configured differently to accommodate different types or arrangements of stairs. For example, an endcap may be configured with a steeper or shallower approach angle as desired. In embodiments, endcaps 106 should provide a relatively smooth transition between stairs 110 and rail segments 102, 104. Also, in embodiments, the concave or u-shaped surface of rail segments 102, 104 may be centered or off-center along the rail segments and may be symmetrical or asymmetrical in curvature and/or wall height. An asymmetrical wall height may permit a user to lean their bicycle toward the lower wall, and still maintain sufficient wall height on both sides of the bicycle while avoiding rubbing the wheel/tire of the bike against the lower wall of the gutter.

Gutter 100 is configured with four support feet 112, although any suitable number of such feet may be used. In FIG. 1A, support feet 112 contact the run surfaces 114 of stairs 110. While in FIG. 1A there are support feet 112 for each stair, in embodiments there may not be a support foot 112 for each stair. Support feet 112 are shown with rounded lower surfaces, which provide a more universal fit to various stairs regardless of the incline angle of the staircase. In embodiments, other shapes and configurations of support feet 112 may be provided, such as having squared or angled edges.

Gutter 100 is identified as "modular" because the configuration of the elements permits 1, 2, 3, or more rail segments to be coupled together, as well as any desired or needed number of support feet to be used.

In use, a user 115 may walk up or down stairs 110 while pushing or guiding bicycle 105 along gutter 100.

Figure 1B:
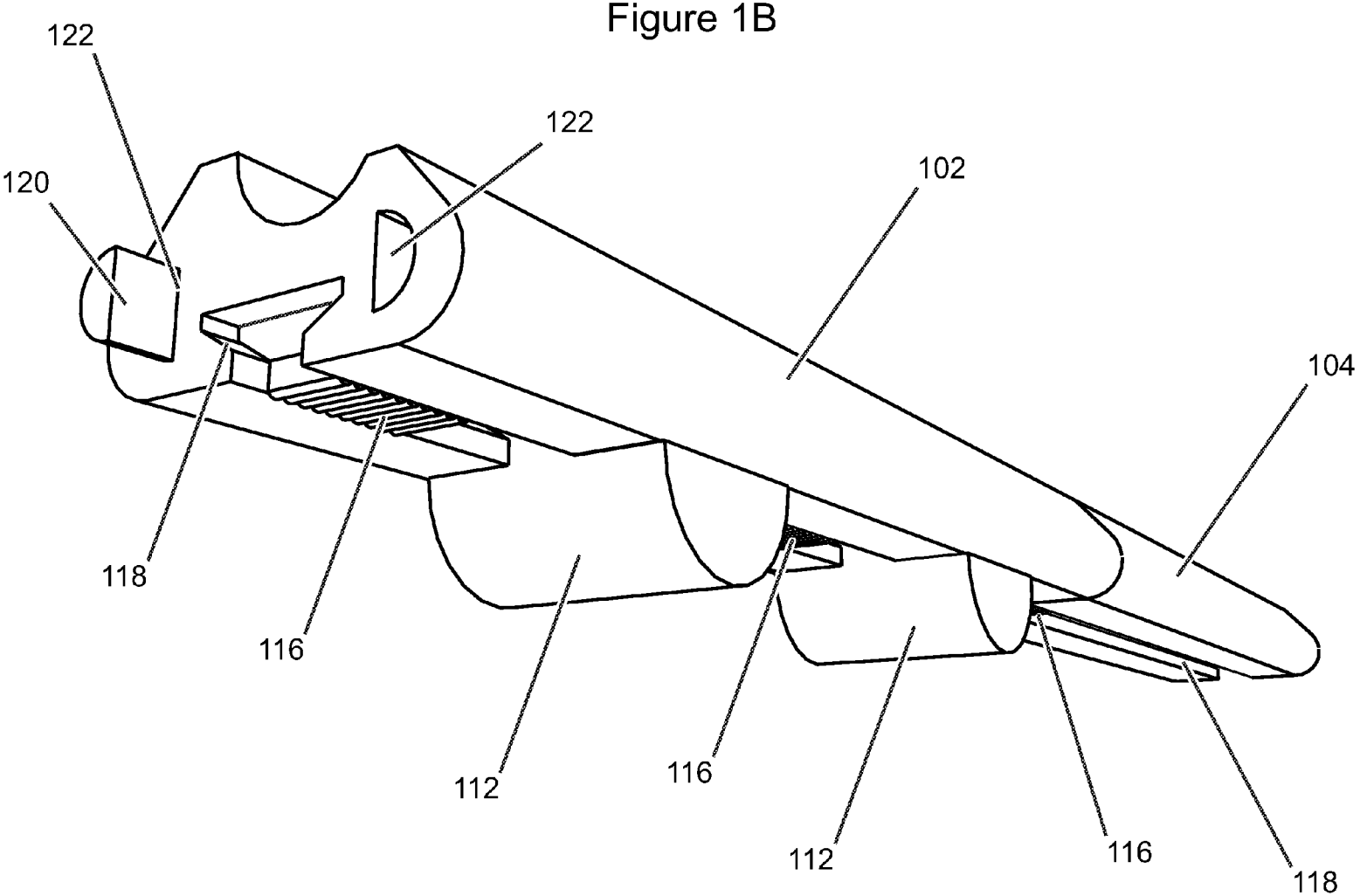
FIG. 1B illustrates a partial perspective view of the modular gutter of FIG. 1 in accordance with various embodiments.

FIG. 1B illustrates a partial perspective view of the modular gutter 100 of FIG. 1 in accordance with various embodiments. FIG. 1B shows rail segments 102 and 104 as well as two support feet 112. In addition, in FIG. 1B, multiple positioning supports 116 are provided. As shown, positioning supports 116 are ribbed/contoured to provide one or more points of contact with an edge of a stair. These points of contact provide a location of increased friction or resistance to secure/stabilize gutter 100 on stairs 110. In addition, positioning supports 116 provide a spacing element between support feet 112 or between a support foot 112 and an endcap 106. Spacing elements may be configured as positioning supports, or, in embodiments, spacing elements may be constructed with the primary function of spacing, with or without a positioning or other function. While one positioning support 116 is shown between support feet 112, the spacing may be adjusted by using positioning supports of different sizes and/or using more than one positioning support.

FIG. 1B also illustrates a channel 118 within rail segments 102, 104 into which support feet 112 and positioning supports 116 are inserted. In this embodiment, such elements may be slid into and along channel 118 to arrive at the desired orientation of the elements. In embodiments, the configuration (cross-sectional shape) of channel 118 corresponds to a portion of the elements inserted therein to facilitate a tight or secure fit.

FIG. 1B also illustrates an example mechanism for coupling various components together, such as endcaps 106 and rail segments 102, 104. Connecting rod 120 is shown inserted into a recess 122, which together form a post and pit style end joint. As illustrated, connecting rod 120 and recess 122 exhibit a semicircular cross-sectional shape, which prevent rotation of connecting rod 120 once inserted into recess 122. In other embodiments, other cross-sectional shapes may be utilized, such as square, round, triangular, or any other desired or suitable shape.

While in FIG. 1B a separate connecting rod is illustrated, it should be appreciated by one of skill in the art that integrated connecting rods may be used on any of the various elements described herein. For example, a rail segment may be configured with a male-type rod extending therefrom, which is configured to mate with a female recess on another component (endcap, another rail segment, etc.). In embodiments, other connecting elements, such as slidable rails, tabs, threaded couplings, etc. may be used instead of a connecting rod. In embodiments, connecting elements/means may be present at the terminal or adjoining ends of various components, although other arrangements may also be configured.

In embodiments, one or more elements may be formed from a rubber or other non-slip material. For example, the coupling of two elements formed from rubber, or coated with rubber or including a rubber seal or gasket, may inhibit separation of the elements except for as a result of the application of a sufficiently large force. In addition or alternatively, the joining of elements, such as introducing support feet 112 into channel 118 or coupling rail segment 102 to rail segment 104 as shown in FIG. 1B, may be reinforced using industrial adhesives, nails, screws, bolts, etc.

In other embodiments, there may be an internal locking fit between the components (support feet 112, positioning supports 116) and channel 118 to prevent the rail from sliding once in place. In one embodiment, locking pins (bolts, etc.) may be inserted from the sides of the rails through corresponding holes in the interior components (support feet 112, positioning supports 116) to position the components in a desired location/configuration.

Figure 1C:
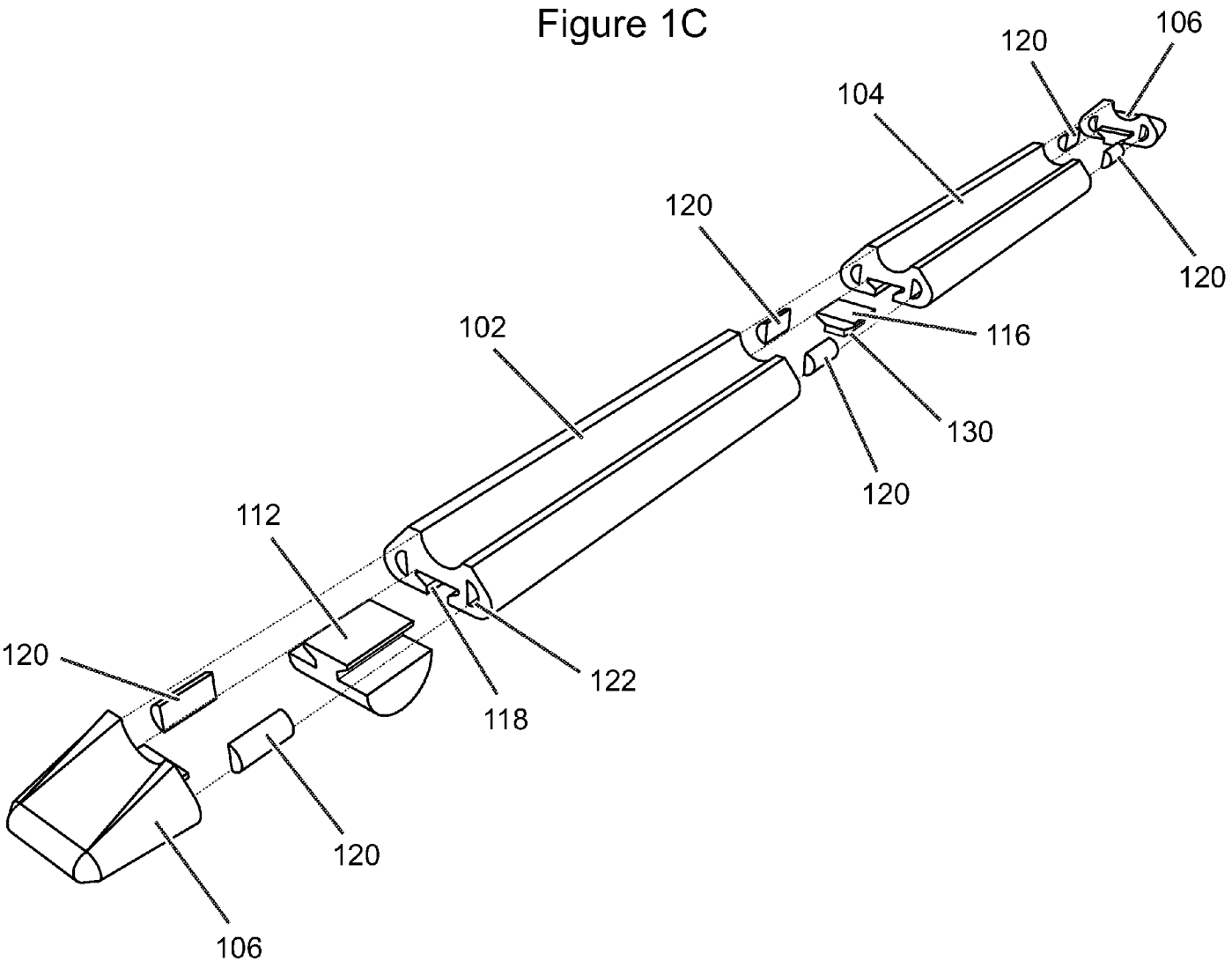
FIG. 1C illustrates a partial exploded view of the modular gutter of FIG. 1 in accordance with various embodiments.

FIG. 1C illustrates a partial exploded view of gutter 100. The manner in which the various components may be coupled together can be seen in this illustration. For example, the alignment and corresponding shape of the top rail of support foot 112 with channel 118 can be seen.

Figure 1D:
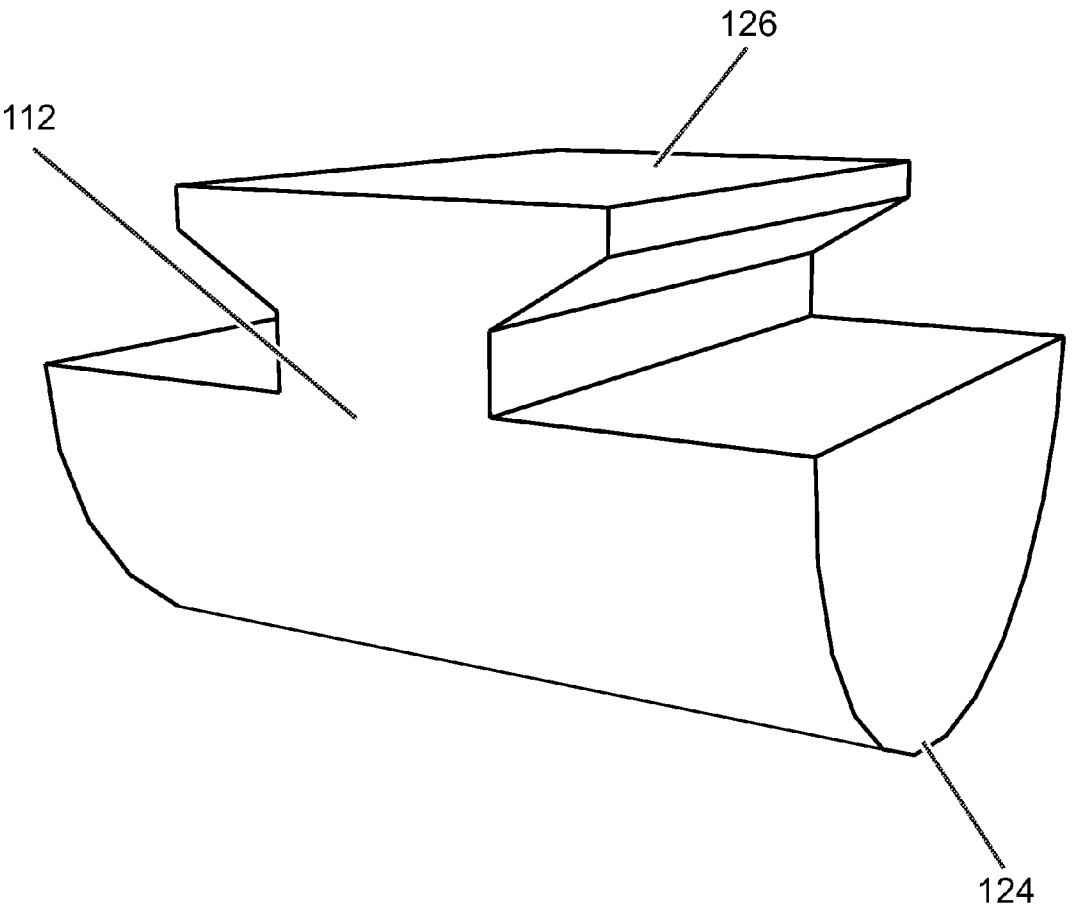
FIG. 1D provides a perspective view of a support foot in accordance with various embodiments.

FIG. 1D provides an expanded view of a support foot 112 in accordance with embodiments. Support foot 112 has a rounded, lower contact surface 124 and an integrated top rail 126 designed to correspond to the shape of channel 118. The particular shape prevents support foot 112 from rotating within channel 118 and limits movement of support foot 112 to movement along the primary, longitudinal axis of channel 118.

Figure 1E:
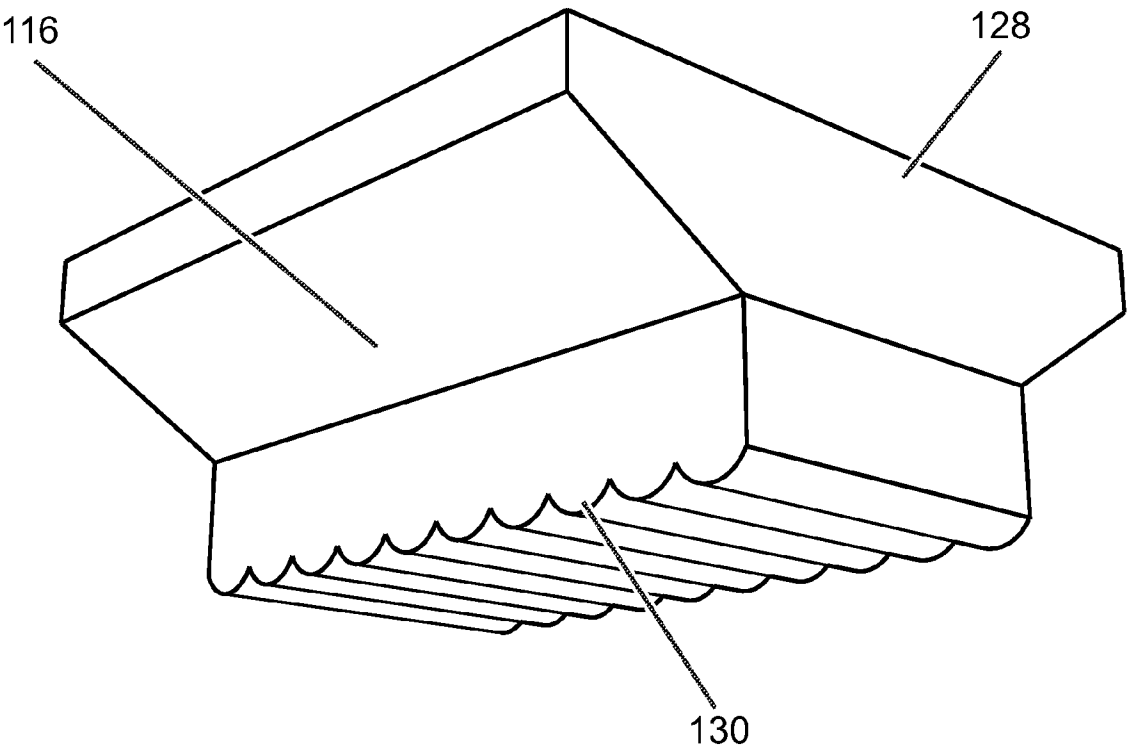
FIG. 1E provides a perspective view of a positioning support in accordance with various embodiments.

Similar to support foot 112, FIG. 1E shows positioning support 116 with an integrated top rail 128 designed to correspond to the shape of channel 118 and control movement as discussed above. Additionally, positioning support 116 has a lower friction surface 130 designed to contact a stair edge and aid in securing gutter 100 in position on stairs 110.

Figure 1G:
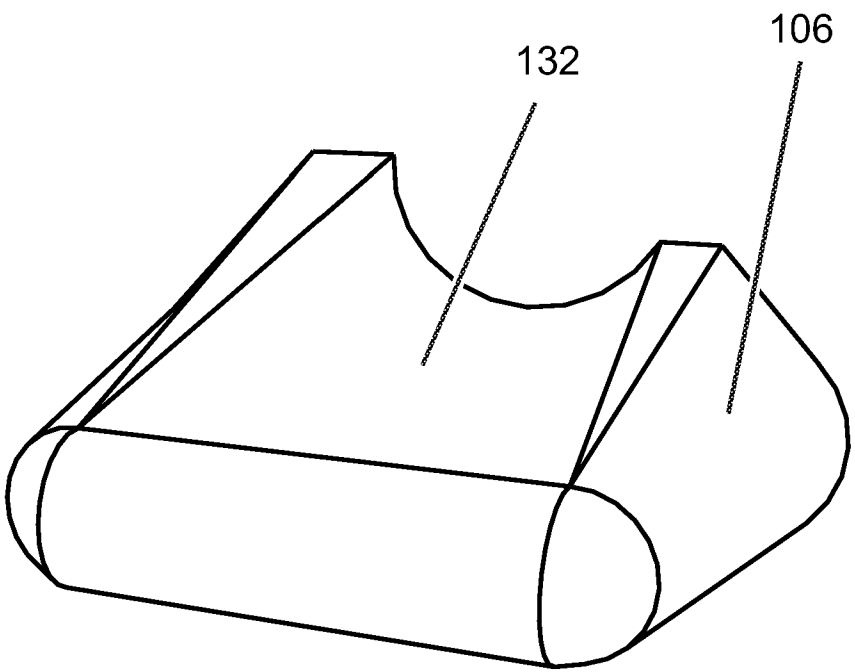
FIGS. 1F and 1G illustrate a rear view and a front view of an endcap in accordance with various embodiments.
Figure 1F:
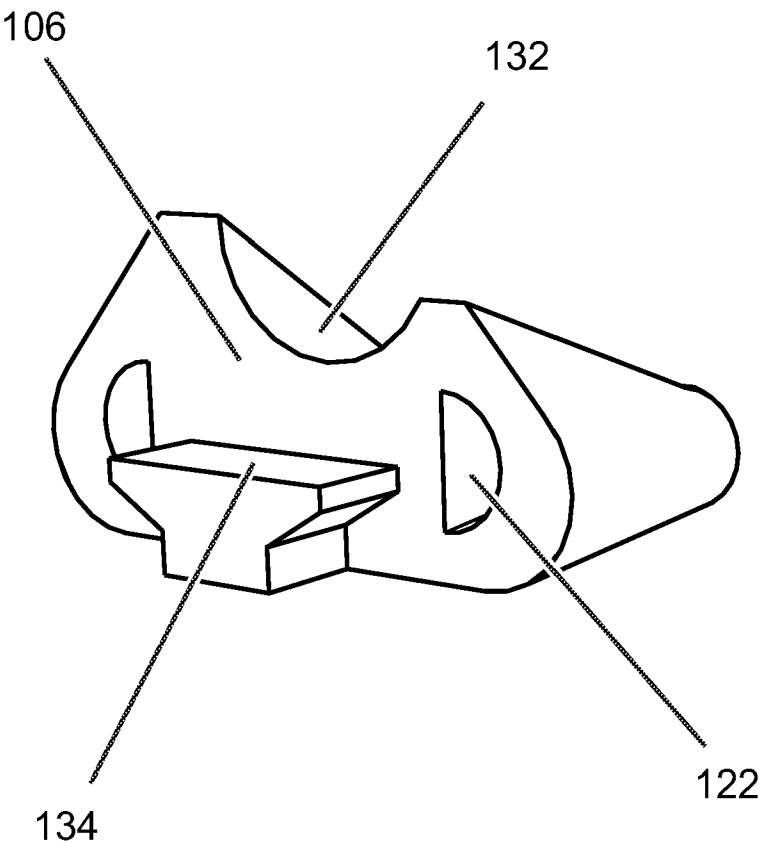

FIGS. 1F and 1G illustrate rear and front views of an endcap 106 in accordance with embodiments herein. Endcap 106 provides a ramp that may be constructed with a variety of slopes and configurations as desired. In a particular embodiment, such as represented in FIG. 1A, endcap 106 provides a fairly shallow approach angle based on its location at the lower portion of stairs 110. Endcap 106 is shown with ramp 132 to effect this approach angle. In embodiments, endcap 106 may be configured with other approach angles. Additionally, endcap 106 shows recesses 122 that permit the coupling via connecting rods 120 to rail segment 102. Endcap 106 is also shown with an integrated rail 134 designed to correspond to the shape of channel 118 to further secure endcap 106 to rail segment 102.

Figure 2A:
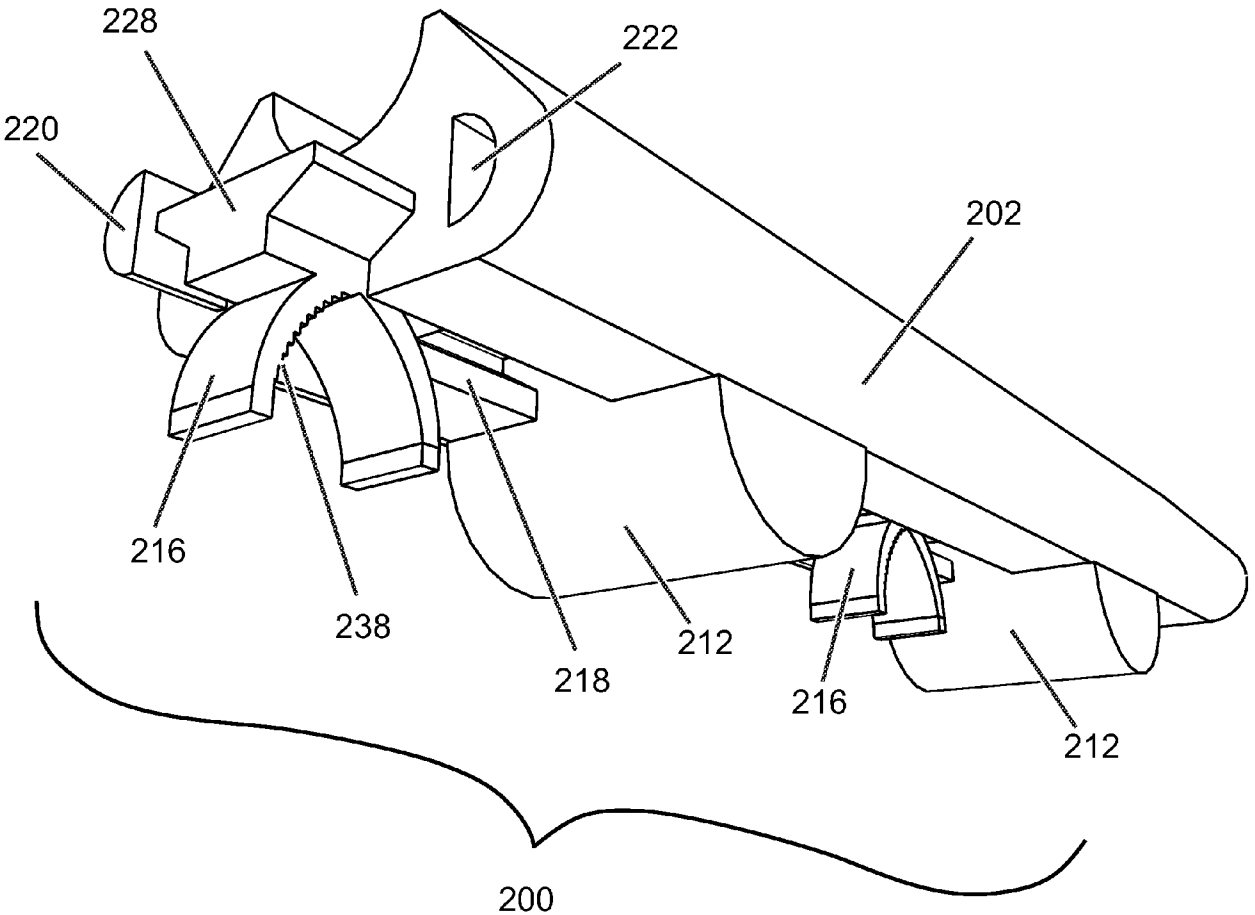
FIG. 2A illustrates an alternative embodiment of a modular gutter in accordance with embodiments herein.
Figure 2B:
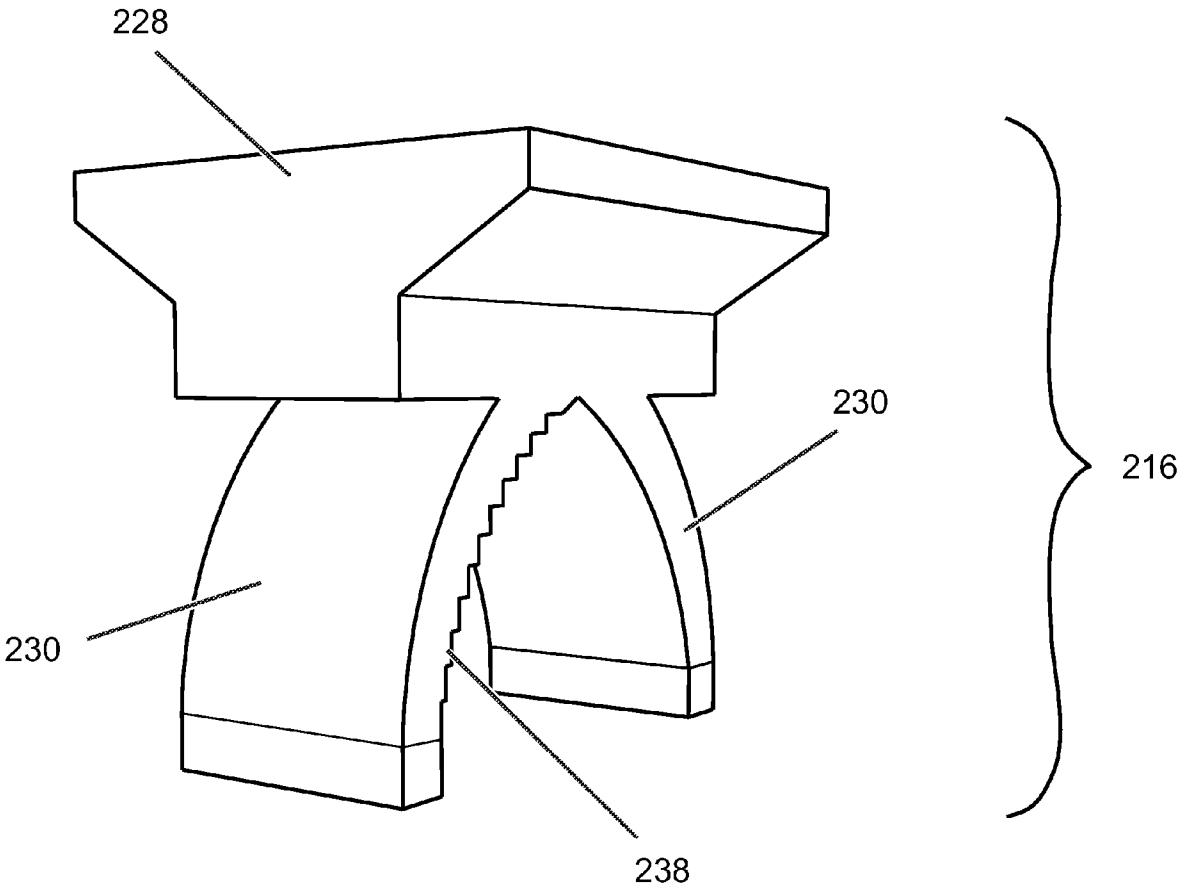
FIG. 2B provides a perspective view of a positioning support in accordance with various embodiments.

FIG. 2A illustrates an alternative embodiment of a modular gutter 200. Gutter 200 has a rail segment 202, support feet 212, a connecting rod 220, and recesses 222. Such features are the same or substantially similar to those presented in FIGS. 1A-1G. However, FIG. 2A illustrates an alternative positioning support 216 (see also FIG. 2B). Positioning support 216 has an integrated top rail 228 designed to correspond to the shape of channel 218. Positioning support 216 has a claw-style base having two flanges 230 each configured to contact a stair edge. As shown, positioning support 216 has a ribbed/contoured interior 238 configured to further secure positioning support 216 on a stair edge. The angle made between the two flanges of the claw-style base is provided for illustrative purposes, and the angle may be adjusted as desired. In an embodiment, the base may be provided with an integrated adjustment mechanism, such as a flexible joint that permits the flanges of the base to flex/splay in response to the application of force.

Figure 3:
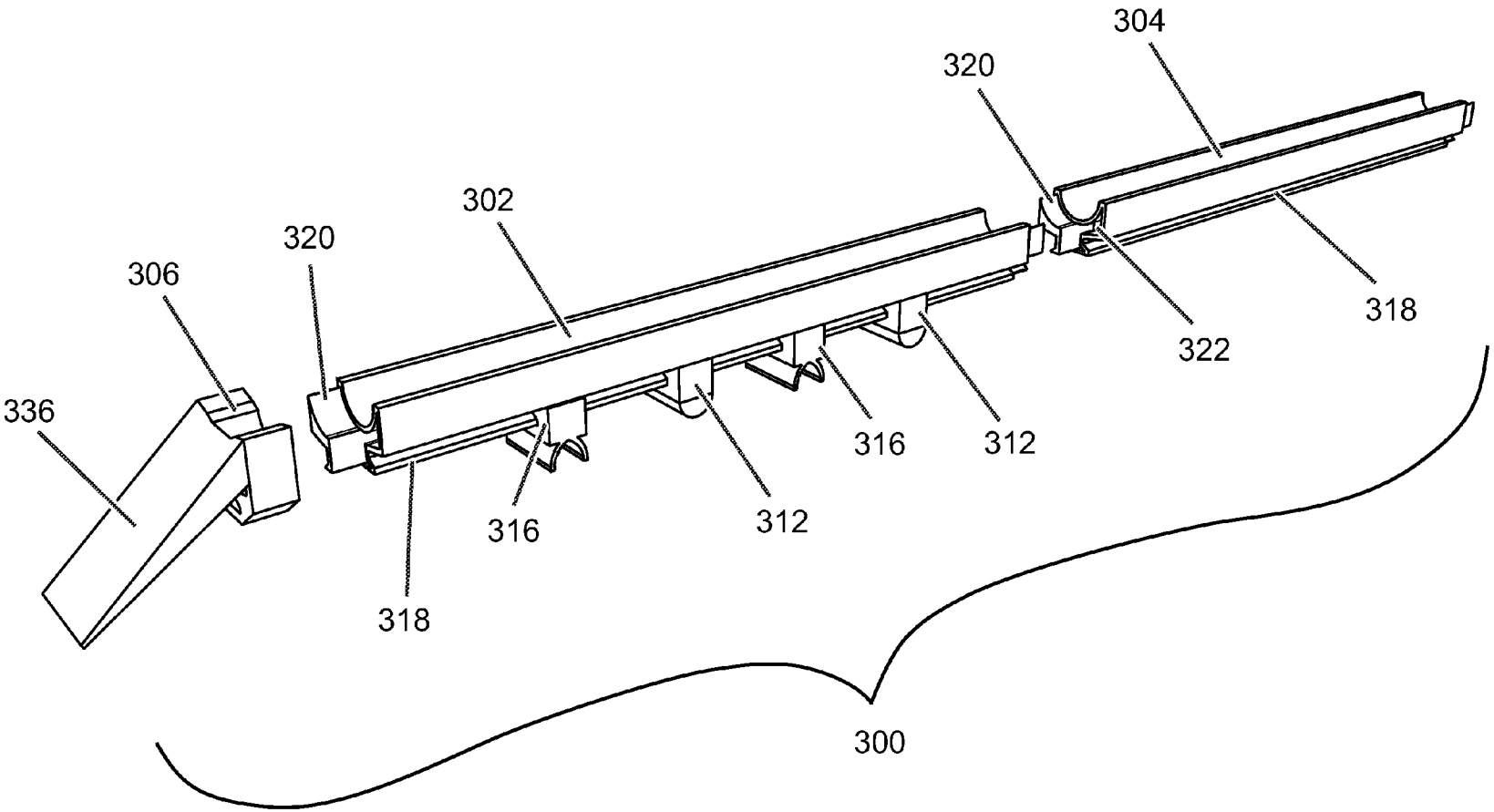
FIG. 3 illustrates an alternative embodiment of a modular gutter in accordance with embodiments herein.

FIG. 3 illustrates an alternative embodiment of a modular gutter 300. Gutter 300 is shown with rail segments 302 and 304, support feet 312, and positioning supports 316. These features provide the same or similar functionality to those described above. In FIG. 3, connecting rod 320 is configured to fit inside a large recess 322 that defines the interior of rail segment 302 or rail segment 304. In addition, rail segments 302 and 304 are provided with an integrated lower rail track 318. Support feet 312 and positioning supports 316 are configured with claw-style upper portions that are configured to fit around and to slide along integrated rail track 318. Similar to the embodiments of FIGS. 1A-1G and FIGS. 2A-2B, support feet 312, positioning supports 316, and rail track 318 are designed to have corresponding shapes to permit slidable engagement with controlled movement so that the components may be at least partially secured in place when the components are coupled together. Endcap 306 illustrates an alternate embodiment that provides a steeper approach angle and a flexible ramp 336 that may permit adjustment of the ramp angle to fit to a variety of configurations and inclines of stairs.

In embodiments, one or more elements may be formed out of recycled crumb rubber or another weather-resistant material offering a balance between flexibility and rigidity sufficient to prevent parts from cracking under stress or becoming too slippery when wet. Gutters may also be formed from one or more other materials such as steel, concrete, plastic, etc.

During installation, gutters may be placed onto or constructed on a staircase. Adhesives, nails, bolts, screws, or other such securing mechanisms may be used to secure the gutter to the staircase, although such features may be omitted. Gutters in accordance with embodiments herein can be removable, impermanent, and retrofittable, and can be configured to fit to any size staircase due to the modular aspects of the design.

In embodiments, a gutter may be contoured, such as having a u-shaped upper surface (the primary contact surface for the conveyance), or, alternatively a gutter may have a flat surface whether or not it is bound by raised edges/sides or not.

In an embodiment, a system may be constructed with more than one gutter, whether separate or coupled together side-by-side or manufactured as a single unit.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A modular gutter for a conveyance, comprising:

one or more rail segments having an upper surface configured to be contacted by the conveyance, an interior channel, and connecting means configured to couple the one or more rail segments to another rail segment or to an endcap; and one or more support feet coupled to the one or more rail segments, wherein the one or more support feet each comprise an integrated top rail configured to correspond in cross-sectional shape to the interior channel.

2. The modular gutter of claim 1, wherein the upper surface is concave.

3. The modular gutter of claim 1, wherein the upper surface is flat.

4. The modular gutter of claim 1, wherein the connecting means comprises one or more recesses configured to receive a connecting rod.

5. The modular gutter of claim 1, wherein the connecting means comprises one or more connecting rods extending from the one or more rail segments and configured to mate with one or more recesses in another rail segment or in an endcap.

6. The modular gutter of claim 1, wherein at least one of the one or more support feet has a rounded lower surface configured to contact a run surface of a stair.

7. The modular gutter of claim 1, further comprising one or more positioning supports.

8. The modular gutter of claim 7, wherein the one or more positioning supports each comprise an integrated top rail configured to correspond in cross-sectional shape to the interior channel.

9. The modular gutter of claim 7, wherein at least one of the one or more positioning supports comprises a ribbed or contoured lower surface configured to contact a stair edge.

10. The modular gutter of claim 7, wherein at least one of the one or more positioning supports comprises a claw having at least two flanges configured to contact a stair edge.

11. The modular gutter of claim 10, wherein at least one of the flanges has a ribbed or contoured interior surface configured to contact a stair edge.

12. The modular gutter of claim 1, further comprising a spacing element having at least a portion configured to correspond in cross-sectional shape to the interior channel.

13. The modular gutter of claim 1, further comprising one or more endcaps configured to couple to the one or more rail segments.

14. The modular gutter of claim 13, wherein the one or more endcaps comprise a ramp that provides a transition between the upper surface of the one or more rail segments and a surface of a staircase.

15. The modular gutter of claim 13, wherein at least one of the one or more endcaps comprises an integrated support foot.

16. The modular gutter of claim 1, wherein the one or more rail segments comprise an asymmetrical wall height.

17. A modular gutter for a conveyance, comprising:

one or more rail segments having an upper surface configured to be contacted by the conveyance, an exterior rail track, and connecting means configured to couple the one or more rail segments to another rail segment or to an endcap; and one or more support feet or positioning supports each having an opening configured to correspond to a cross-sectional shape of the exterior rail track and to couple thereto in slidable engagement to permit positioning the one or more support feet or positioning supports anywhere along the exterior rail track.

18. A modular gutter for a conveyance, comprising:

one or more rail segments having an upper surface configured to be contacted by the conveyance, an interior channel, and connecting means configured to couple the one or more rail segments to another rail segment or to an endcap; and one or more positioning supports coupled to the one or more rail segments, wherein the one or more positioning supports each comprise an integrated top rail configured to correspond in cross-sectional shape to the interior channel.

19. The modular gutter of claim 18, wherein at least one of the one or more positioning supports comprises a ribbed or contoured lower surface configured to contact a stair edge.

20. The modular gutter of claim 18, wherein at least one of the one or more positioning supports comprises a claw having at least two flanges configured to contact a stair edge.

21. The modular gutter of claim 20, wherein at least one of the flanges has a ribbed or contoured interior surface configured to contact a stair edge.

22. A modular gutter for a conveyance, comprising:

one or more rail segments having an upper surface configured to be contacted by the conveyance, an interior channel, and connecting means configured to couple the one or more rail segments to another rail segment or to an endcap; and one or more support feet or positioning supports each comprising an integrated top rail configured to correspond in cross-sectional shape to the interior channel and to couple thereto in slidable engagement to permit positioning the one or more support feet or positioning supports anywhere along the interior channel.

* * * * *